US009538888B2

(12) United States Patent
Chen et al.

(10) Patent No.: US 9,538,888 B2
(45) Date of Patent: Jan. 10, 2017

(54) TOILET SEAT COVER WITH AN EASILY ASSEMBLED AND DETACHED CHILD SEAT

(71) Applicant: HOTI (XIAMEN) PLUMBING INC., Xiamen (CN)

(72) Inventors: Guobin Chen, Xiamen (CN); Feng Guo, Xiamen (CN)

(73) Assignee: HOTI (XIAMEN) PLUMBING INC., Xiamen, Fujian (CN)

( * ) Notice: Subject to any disclaimer, the term of this patent is extended or adjusted under 35 U.S.C. 154(b) by 188 days.

(21) Appl. No.: 14/639,125

(22) Filed: Mar. 5, 2015

(65) Prior Publication Data

US 2016/0015226 A1 Jan. 21, 2016

(30) Foreign Application Priority Data

Jul. 18, 2014 (CN) ..... 2014 1 0343643

(51) Int. Cl.

| | |
|---|---|
| ***A47K 13/00*** | (2006.01) |
| ***A47K 13/06*** | (2006.01) |
| ***A47K 13/26*** | (2006.01) |
| *A47K 13/12* | (2006.01) |

(52) U.S. Cl.

CPC ..... *A47K 13/06* (2013.01); *A47K 13/26* (2013.01); *A47K 13/12* (2013.01)

(58) Field of Classification Search

CPC ..... A47K 13/005; A47K 13/06; A47K 13/12; A47K 13/26

USPC ..... 16/259, 263, 266, 381; 297/239, 256.13, 297/256.16; 4/234–236, 239–240, 902

See application file for complete search history.

(56) References Cited

U.S. PATENT DOCUMENTS

| | | | | |
|---|---|---|---|---|
| 4,680,816 A * | 7/1987 | Colombani | A47K 13/12 | 4/236 |
| 5,142,740 A * | 9/1992 | Amaki | A47K 13/10 | 16/381 |
| 5,749,104 A * | 5/1998 | Evans | A47K 13/06 | 4/239 |
| 5,901,383 A * | 5/1999 | Yanagawa | A47K 13/12 | 4/236 |
| 5,918,322 A * | 7/1999 | Yamamoto | A47K 13/12 | 4/248 |
| 6,449,780 B1 * | 9/2002 | Merry | A47K 13/06 | 4/235 |
| 7,845,027 B2 * | 12/2010 | Er | A47K 13/12 | 4/236 |
| 8,631,521 B1 * | 1/2014 | Baker | A47K 13/12 | 4/236 |

* cited by examiner

*Primary Examiner* — Paul R Durand
*Assistant Examiner* — Nicholas Ros
(74) *Attorney, Agent, or Firm* — Leong C. Lei

(57) ABSTRACT

A toilet seat cover with an easily assembled and detached child seat includes an upper lid, a parent seat and a child seat. Two fixing shafts are respectively sleeved on two parent shaft sleeves. Two pins of two supports and the two fixing shafts are radially held with each other. Each of the two fixing shafts is axially inserted by a cylindrical shaft post. Two elastic c-shaped rings are respectively disposed at two ends of a child shaft sleeve and radially sleeved on the shaft post. At least one end of the child shaft sleeve disposes a central shaft which is radially inserted into a directional slot. When the child seat is not needed, the shaft post can be removed from the fixing shaft to attain a toilet seat cover with a common appearance.

10 Claims, 12 Drawing Sheets

TOILET SEAT COVER WITH AN EASILY ASSEMBLED AND DETACHED CHILD SEAT

(a) TECHNICAL FIELD OF THE INVENTION

This invention relates to a toilet seat cover for a closestool and relates particularly to a toilet seat cover with an easily assembled and detached child seat.

(b) DESCRIPTION OF THE PRIOR ART

A China patent published by CN201143181Y discloses a dual-use toilet seat cover adapted to adults and children. A child seat of the toilet seat cover is disposed between a lid and an adult seat. The lid, the adult seat and the child seat are hinged on the bottom of the closestool. This toilet seat cover has some problems. For example, the shaft sleeves in the rear of the lid, the adult seat and the child seat and the bottom of the closestool share the same pins for connection. When the child grows into a teenager and no longer uses the child seat, this child seat becomes a redundant part and causes inconvenience to the daily cleaning work. It is also difficult to detach the child seat from the bottom of the closestool. If the child seat is detached, the part where the child seat is originally connected to the bottom of the closestool is exposed to the outside, and such exposure is detrimental to the whole appearance of the toilet seat cover and gives a bad impression. Further, the adult seat and the child seat do not have a rotating and buffering effect, so the child may get hurt or shocked at the time of using the seat by himself if the toilet set falls quickly and freely.

A China patent published by CN2593718Y discloses a dual-use toilet seat cover which has a large seat forming a bore adapted to children and a small seat hinged to the large seat for closing the bore. Because the small seat is hinged to the large seat for closing the bore, the change in the appearance of the toilet seat cover is quite apparent. When the child grows into a teenager or an adult, this bore is no longer used, and the toilet seat cover does not need the dual use anymore. The existence of the small seat on the large seat affects the appearance of the whole toilet seat cover and puts an increased strain on the daily cleaning work.

SUMMARY OF THE INVENTION

It is an object of this invention to provide a toilet seat cover with an easily assembled and detached child seat which allows a child seat to be in quick and detachable cooperation with a parent seat adapted to adults by a certain angle and allows the appearance of the toilet seat cover constructed by hinging the parent seat to an upper lid to be the same as the appearance of a general toilet seat cover after the child seat is removed.

Accordingly, the toilet seat cover with an easily assembled and detached child seat in accordance with this invention comprises an upper lid hinged to a parent seat and a child seat disposed between the upper lid and the parent seat. A child shaft sleeve is disposed in a rear of the child seat and located between two parent shaft sleeves which are disposed at two sides of a rear of the parent seat. Each parent shaft sleeve has a fixing shaft disposed therein for allowing a rotation thereof about the fixing shaft. Two supports have respective pins, each of which is radially inserted in or extracted from each of the fixing shafts. This invention is characterized in that a cylindrical shaft post is axially sleeved on each of the two fixing shafts. Two elastic c-shaped rings are respectively disposed at two ends of the child shaft sleeve and radially sleeved on the shaft post. At least one of the two ends of the child shaft sleeve has a central shaft radially inserted into a directional slot. When a direction in which the c-shaped ring is radially sleeved on the shaft post is the same as a direction in which the central shaft is radially inserted into the directional slot, the shaft post and the c-shaped ring cooperate by radial insertion and extraction, and the central shaft and the directional slot cooperate by radial insertion and extraction. When a direction in which the c-shaped ring is radially disconnected from the shaft post is different from a direction in which the central shaft is radially withdrawn from the directional slot, the c-shaped ring and the central shaft cooperate to limit the shaft post.

Preferably, the directional slot radially defined by the shaft post slopes up or is perpendicular to a horizontal surface. When the directional slot slopes up, a direction in which the child seat is connected to the shaft post and a direction in which the child seat is disconnected from the shaft post are oblique. When the directional slot is perpendicular to the horizontal surface, the direction in which the child seat is connected to the shaft post and the direction in which the child seat is disconnected from the shaft post are in a perpendicular direction. The radial directions of the insertion and the extraction between the directional slot and the central shaft are defined to determine the directions in which the c-shaped ring in the rear of the child seat radially locks with and separates from the shaft post, thereby deciding angles whereby the child seat is connected to and disconnected from the shaft post. When the direction in which the child seat is disconnected from the shaft post is different from the direction in which the central shaft is extracted from the directional slot, the central shaft slides along the directional slot to make the shaft post press against the c-shaped ring. Thus, the c-shaped ring and the central shaft grip and limit the shaft post to render the shaft post unable to separate from the c-shaped ring.

Preferably, the directional slot radially defined by the shaft post goes up from a horizontal and slopes by 45°±3°, namely, an upward inclination angle between the directions of connecting the child seat to the shaft post and disconnecting the child seat from the shaft post and a horizontal direction can be set at 45°±3°. Preferably, the directional slot slopes up by 45° in the preferred embodiment.

Preferably, a buffer is sleeved on and fixed in the child shaft sleeve. The central shaft is a damping output shaft of the buffer. The damping output shaft is disposed in the c-shaped ring. Two flat stop surfaces are radially formed on the damping output shaft to abut on the directional slot. The child shaft sleeve fixed to the buffer is rotated relative to the damping output shaft to allow the child seat to provide a rotary and buffering effect.

Preferably, an adapting sleeve is sleeved on and fixed to each end of the child shaft sleeve. The c-shaped ring is disposed on the adapting sleeve. A rigid c-shaped sleeve is formed at each end of the child shaft sleeve and disposed around an outer wall of the c-shaped ring. A clearance fit is provided between the c-shaped ring and the c-shaped sleeve. With respect to the child seat made from the thermosetting material (rigid), the rigid c-shaped sleeve is directly formed at each end of the child seat and adapted to align with the c-shaped ring. The clearance fit between the c-shaped ring and the c-shaped sleeve allows the c-shaped sleeve to have an elastic space for deformation. Thus, the shaft post can radially squeeze a radial opening of the c-shaped ring and lodge in the c-shaped ring. The c-shaped ring where the shaft post lodges is rotated because of the rotation of the child seat, and the c-shaped is rotated about the shaft post.

Preferably, the buffer is sleeved on and fixed in the adapting sleeve. The damping output shaft of the buffer is projected from the adapting sleeve and located inside the c-shaped ring. With respect to the child seat made from the thermoplastic material (with proper elasticity), the c-shaped ring is directly formed at two ends of the child shaft sleeve, and the buffer is directly fixed and sleeved to two ends of the child shaft sleeve. The damping output shaft is lodged in the directional slot and provides a stop running fit with the wall of the directional slot by using the flat stop surfaces, thereby generating a rotary damping force on the child shaft sleeve sleeved on and fixed to the buffer. The c-shaped ring is rotated about the shaft post under the rotary damping force to allow the child seat to have a rotating and buffering effect.

Preferably, a positioning sleeve is axially disposed on the shaft post, and a positioning pin is axially disposed on the fixing shaft. The positioning sleeve and the positioning pin are held with each other. The shaft post can be axially extracted from the fixing shaft to disconnect the shaft post from the fixing shaft and render the child seat unable to connect to the fixing shaft. Thus, the child seat can be removed to convert the toilet seat cover as claimed into a traditional seat cover with a good appearance.

Preferably, the parent shaft sleeve includes a hole formed at the end thereof. The positioning sleeve is inserted into the hole for holding the positioning pin of the fixing shaft in the parent shaft sleeve. A running fit is provided between the hole and the positioning sleeve. Because the connection between the positioning sleeve of the shaft post and the positioning pin of the fixing shaft occurs in the parent shaft sleeve, the hole at the end of the parent shaft sleeve does not affect the whole appearance of the traditional toilet seat cover after the shaft post and the fixing shaft are disconnected.

Preferably, two plugs can be respectively disposed to block the holes. After the shaft post and the fixing shaft are disconnected, the hole at the end of the parent shaft sleeve can be blocked by the plug. The plug not only decorates but also prevents unclean substance or water from entering the parent shaft sleeve through the hole and causing bacteria.

Preferably, at two sides of a rear of the upper lid are disposed two lid shaft sleeves, each of which is sleeved on each of the parent shaft sleeves at two sides of the rear of the parent seat by a pivot.

By adopting the aforementioned structure, two shaft posts are respectively held with the fixing shafts in the parent shaft sleeve, and the child seat is radially sleeved on the shaft posts by an angle of the directional slot. In other words, the central shaft in the rear of the child seat is inserted into the directional slot radially formed on the shaft post, and the elastic c-shaped ring in the rear of the child seat locks with the shaft post radially and elastically to allow the rear of the child seat to rotate on the shaft post. When an angle formed between the child seat and a horizontal surface is different from an orientation angle of the directional slot, the direction in which the central shaft slides off the directional slot and the direction in which the c-shaped ring separates from the shaft post are not in the same radial direction at the time of pulling the child seat. Thence, the c-shaped ring and the central shaft grip and limit the shaft post to render the shaft post unable to disconnect from the c-shaped ring. Thus, the child seat cannot be detached. When the angle formed between the child seat and the horizontal surface is the same as the orientation angle of the directional slot, the direction in which the central shaft slides off the directional slot is the same as the direction in which the c-shaped ring separates from the shaft post. When the child seat is detached from the shaft post, the c-shaped ring is elastically stretched and displaced by the shaft post so that the shaft post can be disconnected from the c-shaped ring. After the child seat and the shaft post are disconnected, the shaft post can be directly extracted from the fixing shaft to convert this invention into a beautiful, traditional and general toilet seat cover.

The advantages of this invention are:

1. Because the shaft post adapted to connect to the child seat can cooperation with the fixing shaft by axial insertion and extraction, the shaft post can be detached from the fixing shaft as the child seat is no longer used. Thus, this invention can have a changed appearance the same as the appearance of a traditional toilet seat cover.

2. The c-shaped sleeve and the central shaft are particularly disposed on the child shaft sleeve. When the child seat slopes by an inclination angle to align with the directional slot, the c-shaped sleeve can be in flexible cooperation with the shaft post by radial insertion and extraction, and the central shaft can be radially inserted in and extracted from the directional slot of the shaft post. Thus, the child seat can be removed from the shaft post. When the inclination angle of the child seat does not align with the directional slot of the shaft post, the c-shaped sleeve and the central shaft limit the shaft post to render the child seat unable to separate from the shaft post.

DETAILED DESCRIPTION OF THE PREFERRED EMBODIMENTS

The advantages of this invention are described in conjunction with the following embodiment and accompanying drawings.

Figure 1:
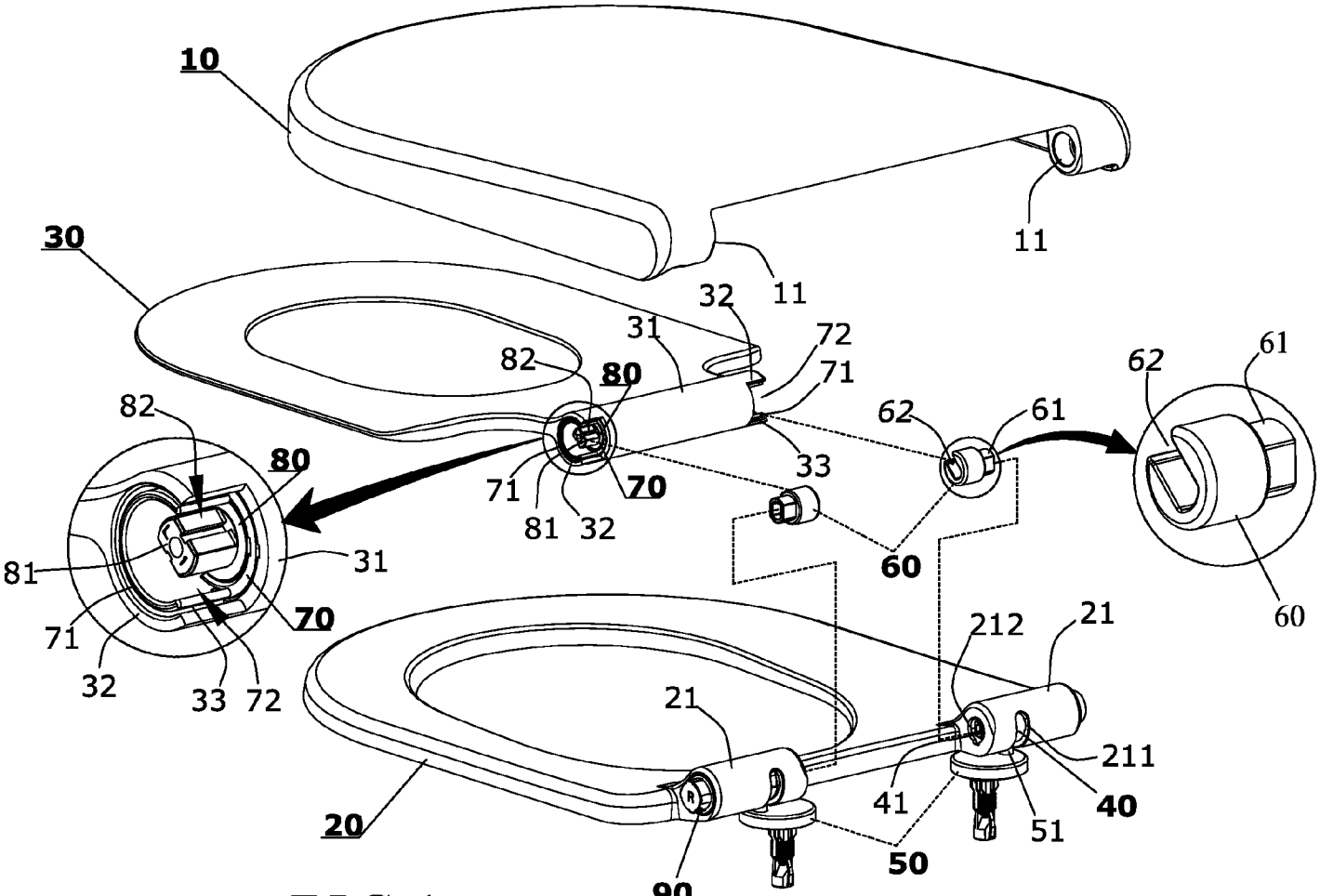
FIG. 1 is an exploded view showing this invention.
Figure 3:
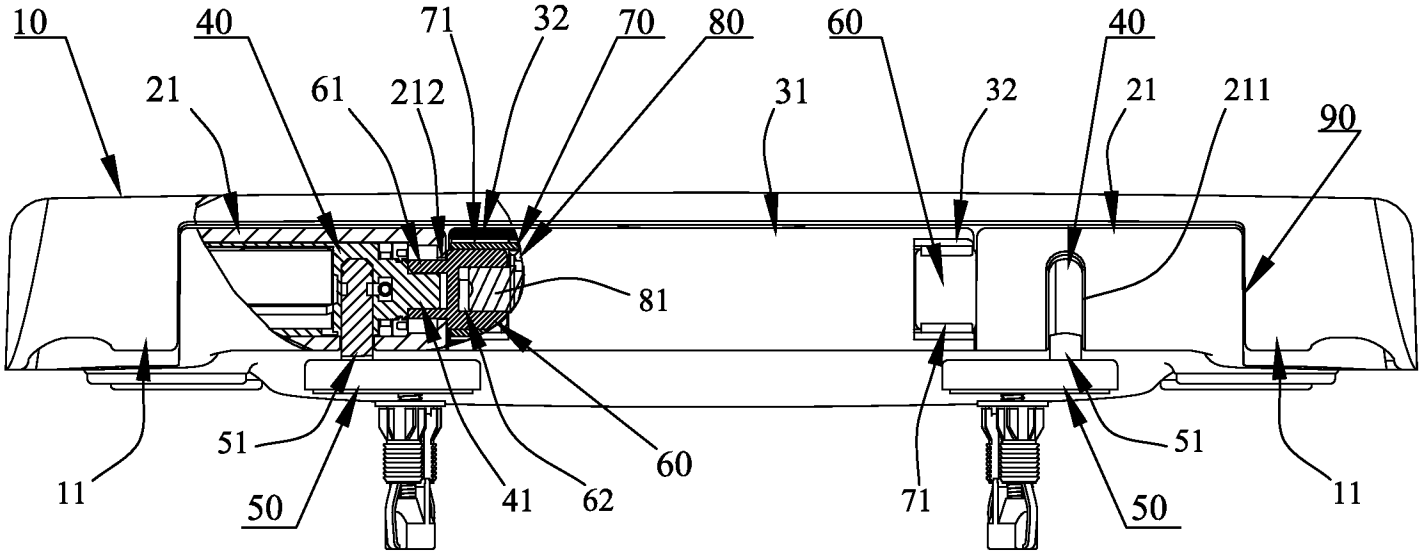
FIG. 3 is a cross-sectional view showing this invention.
Figure 4:
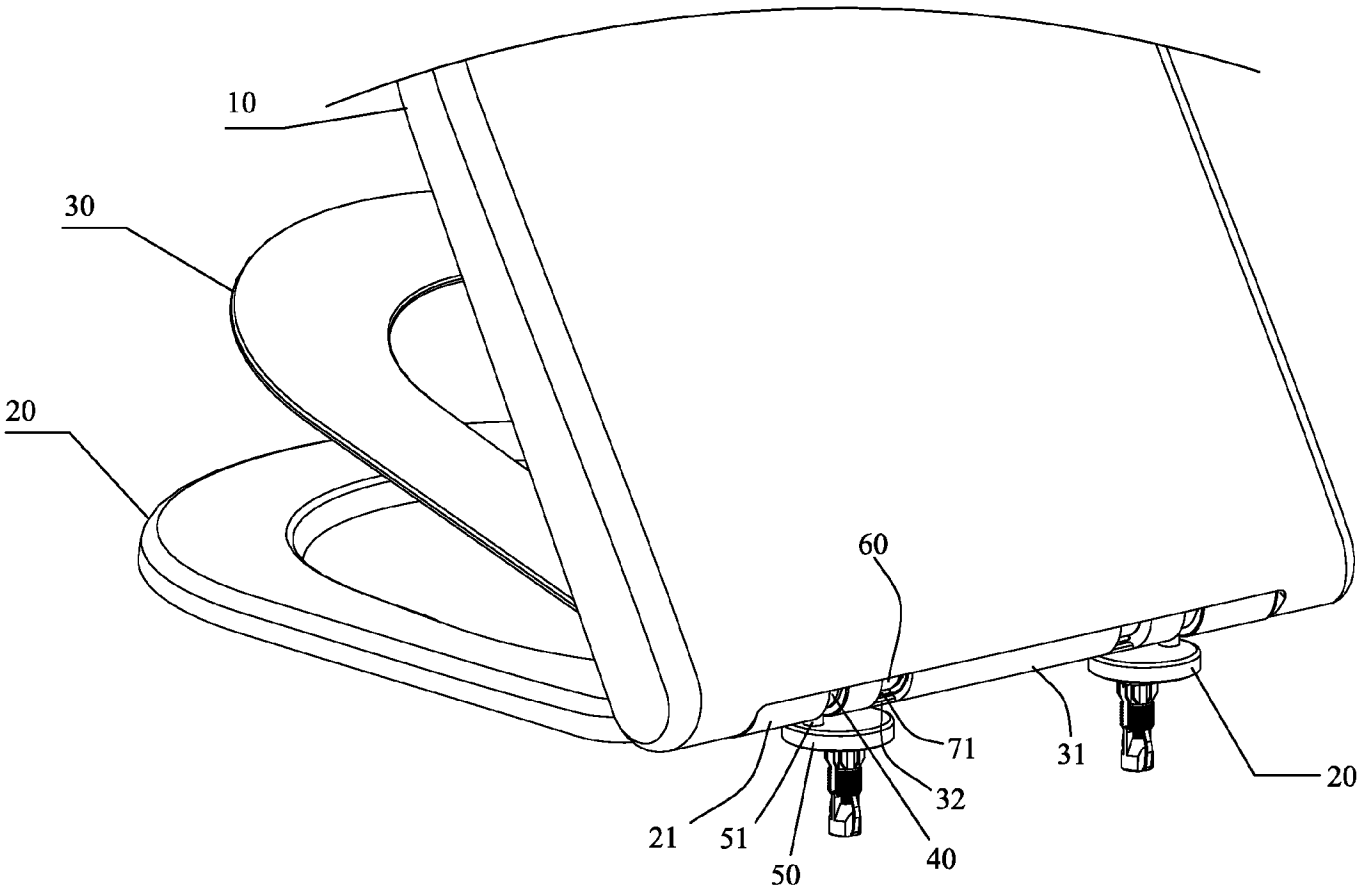
FIG. 4 is a perspective view showing this invention in an open state.

Referring to FIG. 1, FIG. 3 and FIG. 4, a toilet seat cover with an easily assembled and detached child seat of this invention comprises an upper lid 10, a parent seat 20 and a child seat 30 disposed between the upper lid 10 and the parent seat 20. A child shaft sleeve 31 is disposed in a rear of the child seat 30 and located between two parent shaft sleeves 21 disposed at two sides of a rear of the parent seat 20. Two lid shaft sleeves 11 are respectively disposed at an outside of the parent shaft sleeve 21. A fixing shaft 40 about which the parent shaft sleeve 21 is rotated is disposed inside each of the two parent shaft sleeves 21. Two supports 50 with respective pins 51 are disposed. Each pin 51 is inserted into a slot 211, which is radially defined on the parent shaft sleeve 21, and radially connected to the fixing shaft 40. The lid shaft sleeves 11 are disposed at two sides of the rear of the upper lid 10. The lid shaft sleeve 11 is sleeved on the parent shaft sleeve 21 in the rear of the parent seat 20 by a pivot 90. The upper lid 10, the parent seat 20, the pivots 90, the fixing shafts 40 and the supports 50 are assembled as a general toilet seat cover for a closestool.

Figure 11:
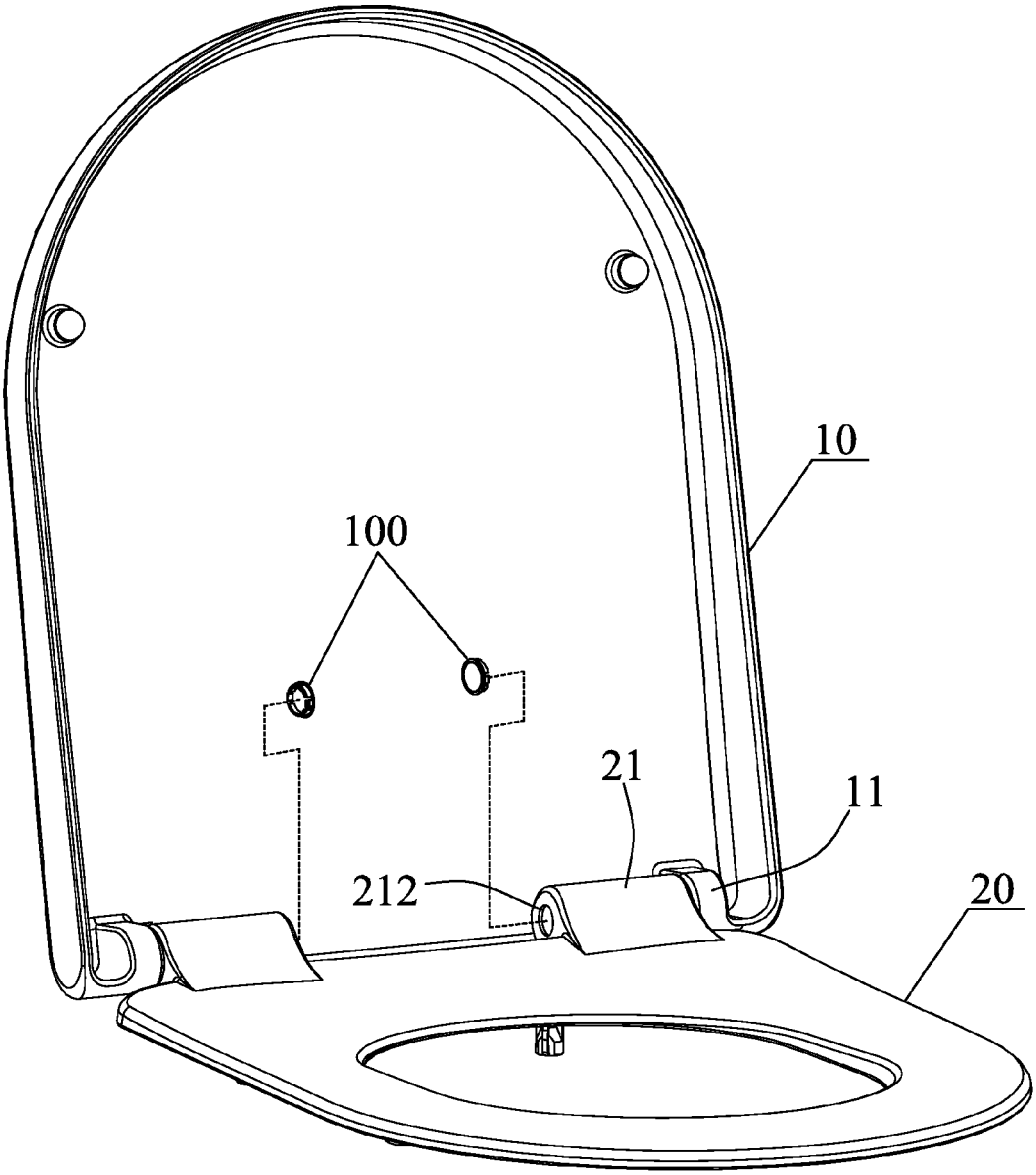
FIG. 11 is a perspective view of this invention showing the plugs adapted to fit the holes.

Referring to FIG. 1, FIG. 3 and FIG. 11, the parent shaft sleeve 21 includes a hole 212 formed at an end thereof.

Referring to FIG. 1 and FIG. 3, two cylindrical shaft posts 60 are provided. Each cylindrical shaft post 60 has a positioning sleeve 61 axially disposed on an axial direction thereof. A directional slot 62 is radially formed on the shaft post 60. The directional slot 62 radially defined on the shaft post 60 goes up from a horizontal and slopes by 45°. A positioning pin 41 is axially disposed on the fixing shaft 40. The positioning sleeve 61 is inserted into the hole 212 for holding the positioning pin 41 of the fixing shaft 40 in the parent shaft sleeve 21 in position. The hole 212 and the positioning sleeve 61 rotatably fit with each other, thereby completing an axial and quick connection of the shaft post 60 to the fixing shaft 40.

Figure 2:
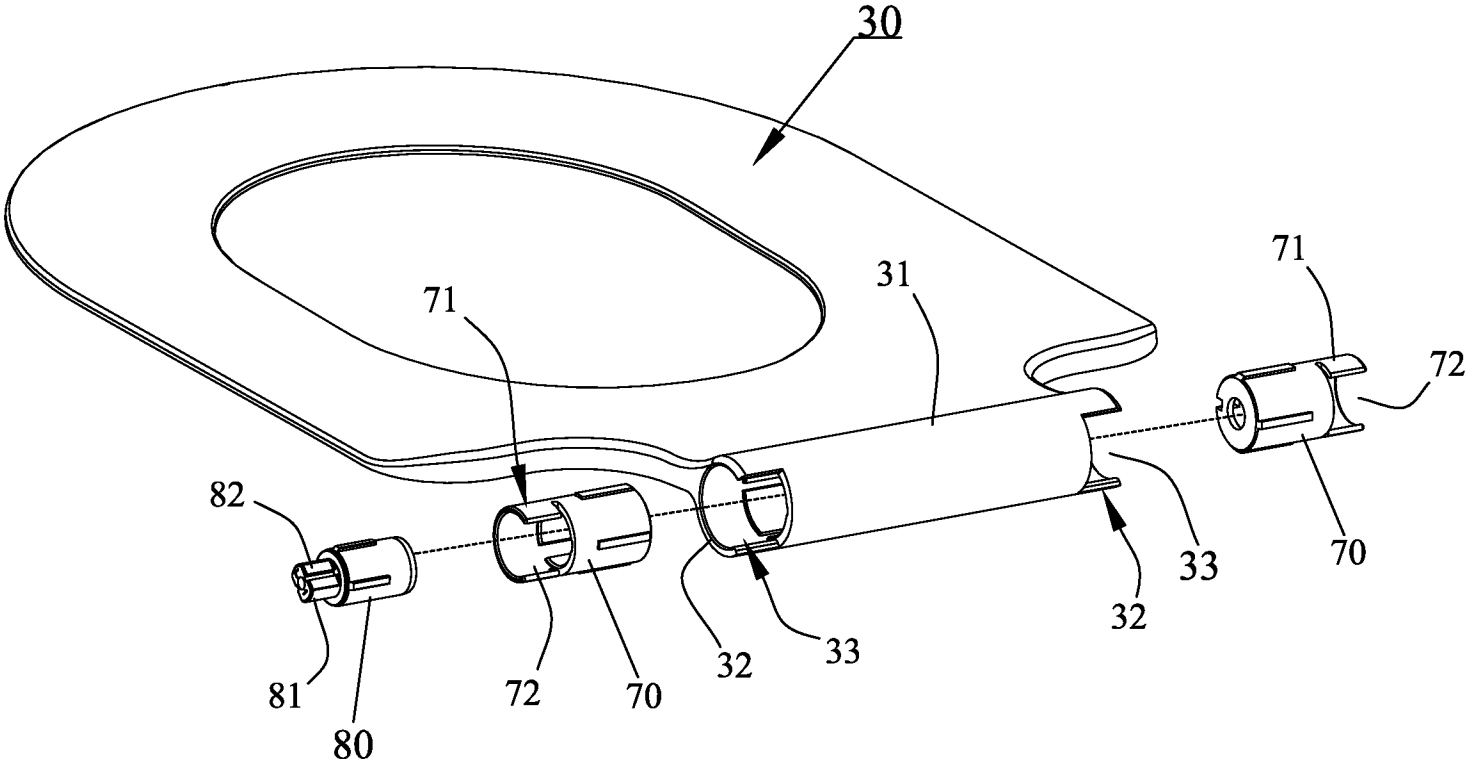
FIG. 2 is an exploded view showing elements for a child seat of this invention.

Referring to FIG. 2, a rigid c-shaped sleeve 32 is formed at each end of the child shaft sleeve 31 that is set in the middle of the rear of the child seat 30. Two adapting sleeves 70 are respectively sleeved on and fixed to two ends of the child shaft sleeve 31. An elastic c-shaped ring 71 is disposed on the adapting sleeve 70 and provides a radial clearance fit with the c-shaped sleeve 32. A direction at which a radial opening 72 of the c-shaped ring is directed is the same as a direction at which a radial opening 33 of the c-shaped sleeve is directed. A buffer 80 is axially sleeved on and fixed in one of the adapting sleeves 70. A damping output shaft 81 of the buffer 80 capable of rotating is disposed in the c-shaped ring 71. Two flat stop surfaces 82 are radially formed on the damping output shaft 81 to abut on the directional slot 62. The other one of the adapting sleeves 70 does not need the buffer 80. Thus, the assembly of the child seat 30 is completed as illustrated in FIG. 1.

Referring to FIG. 1, FIG. 8, FIG. 6 and FIG. 3, the child seat 30 is opened to slope with respect to a horizontal surface by 45°. The radial opening 72 of the c-shaped ring is aimed at the cylindrical shaft post 60. The damping output shaft 81 is radially aimed at the directional slot 62 of the shaft post 60 and inserted into the shaft post 60 by making the child seat 30 slope down, thereby allowing the c-shaped ring 71 to lock with the shaft post 60 elastically and allowing the c-shaped ring 71 to rotate about the shaft post 60. The damping output shaft 81 is radially lodged in the directional slot 62 through the radial opening 72 of the c-shaped ring. The flat stop surfaces 82 of the damping output shaft 81 abut on a wall of the directional slot 62 to provide a stop running fit. As shown in FIG. 7, the adapting sleeve 70 fixed to the other end of the child shaft sleeve 31 does not mount a buffer therein. The shaft post 60, not shown in this figure, is lodged in the c-shaped ring 71 through the radial opening 72 of the c-shaped ring. Thus, the child seat 30 can be mounted on the general toilet seat cover for the closestool.

Figure 6:
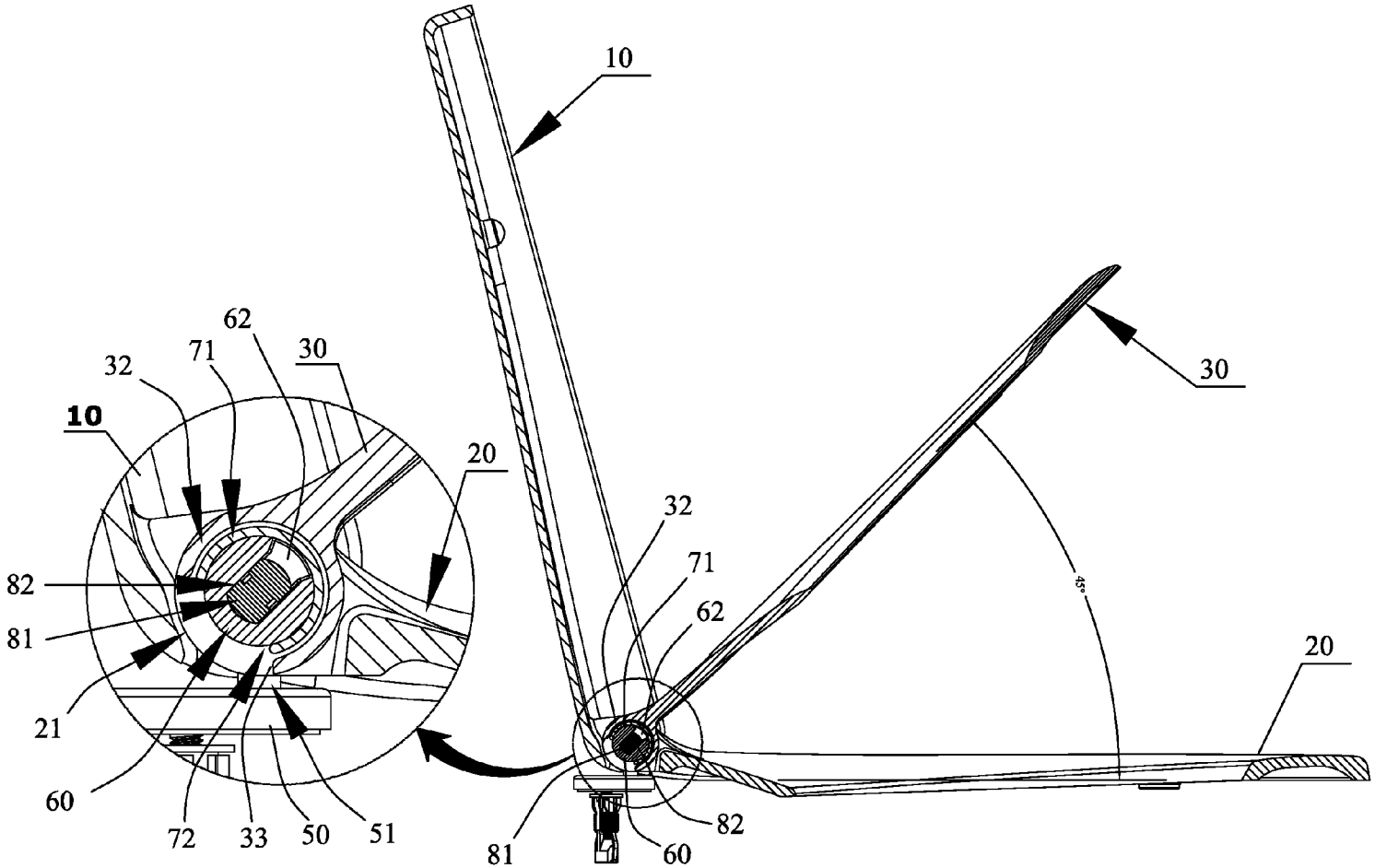
FIG. 6 is a cross-sectional view showing the child seat of this invention which is opened by 45°.
Figure 7:
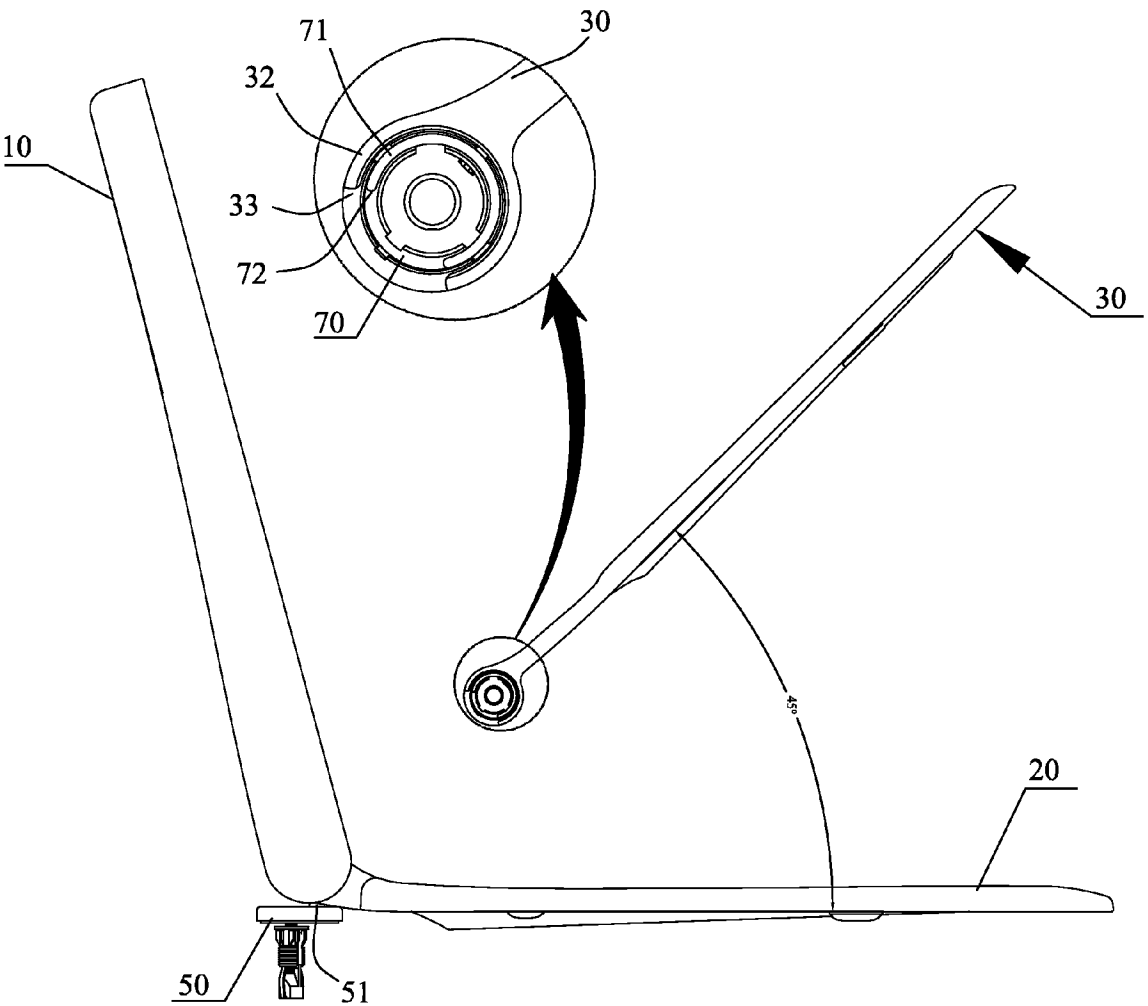
FIG. 7 is a schematic view showing a state of disconnecting the c-shaped ring from the shaft post when the child seat is opened by 45°.
Figure 9:
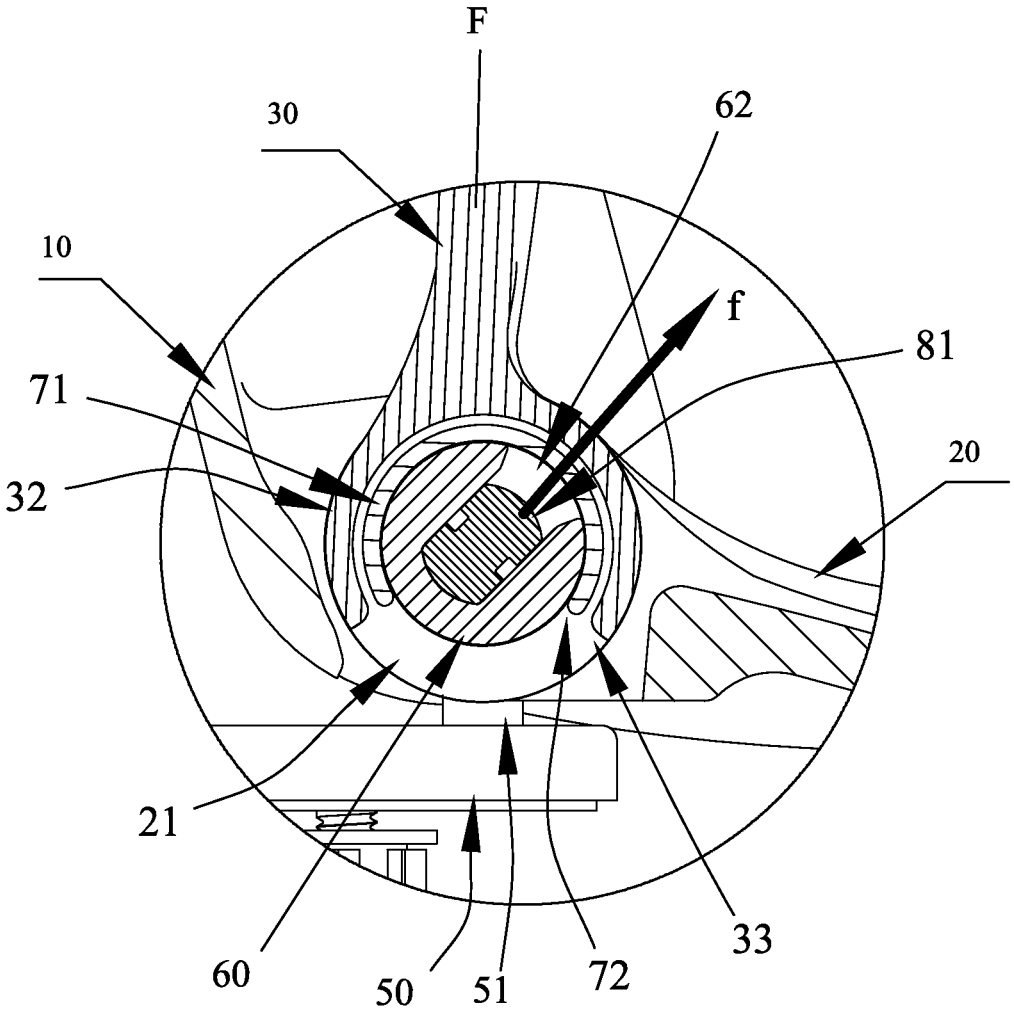
FIG. 9 is a schematic view showing that the c-shaped ring and the central shaft limit the shaft post when the open angle of the child seat is over 45°.
Figure 10:
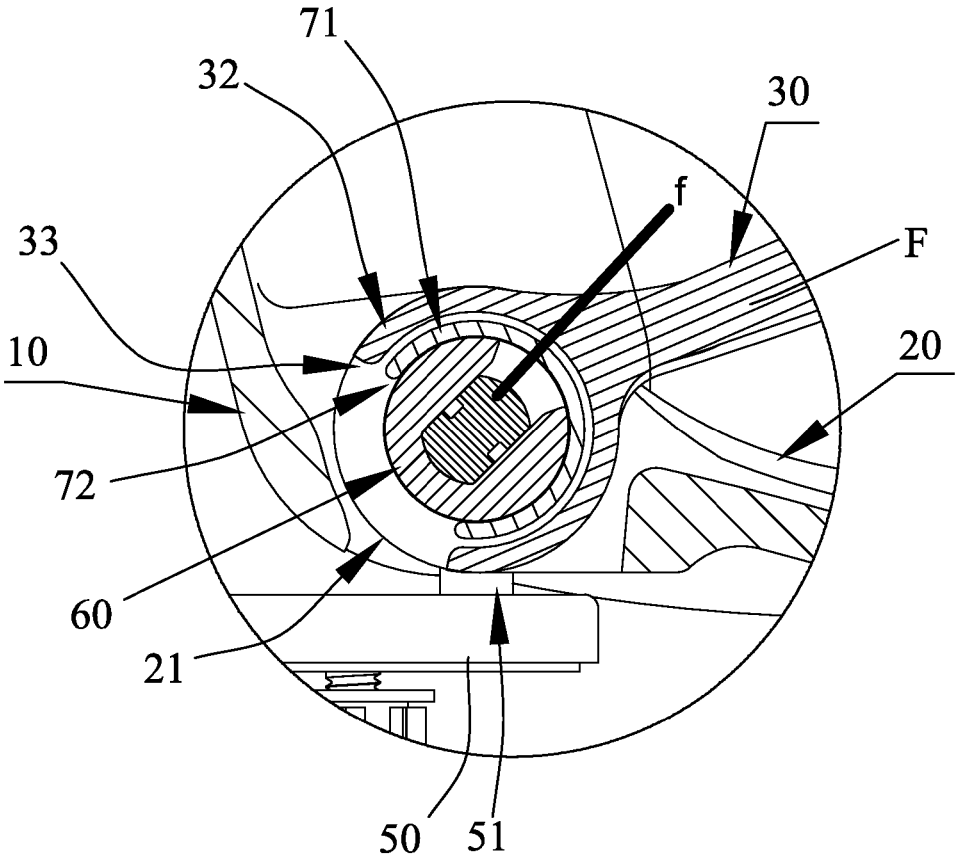
FIG. 10 is a schematic view showing that the c-shaped ring and the central shaft limit the shaft post when the open angle of the child seat is less than 45°.

FIG. 6 shows the upward rotary angle of the child seat 30 is not about 45°. When an angle formed between the child seat 30 and a horizontal surface, as shown in FIG. 9 and FIG. 10, is different from an orientation angle of the directional slot 62, the direction "f" in which the damping output shaft 81 slides off the directional slot 62 and the direction in which the c-shaped ring 71 is disconnected from the shaft post 60 are not in the same radial direction because of an upward pulling force "F" imparted to the child seat 30. A deformation space of the c-shaped ring 71 is radially limited by the rigid c-shaped sleeve 32. The c-shaped ring 71 and the damping output shaft 81 grip and limit the shaft post 60 to render the shaft post 60 unable to separate from the c-shaped ring 71. Thus, the child seat 30 cannot be detached.

Figure 5:
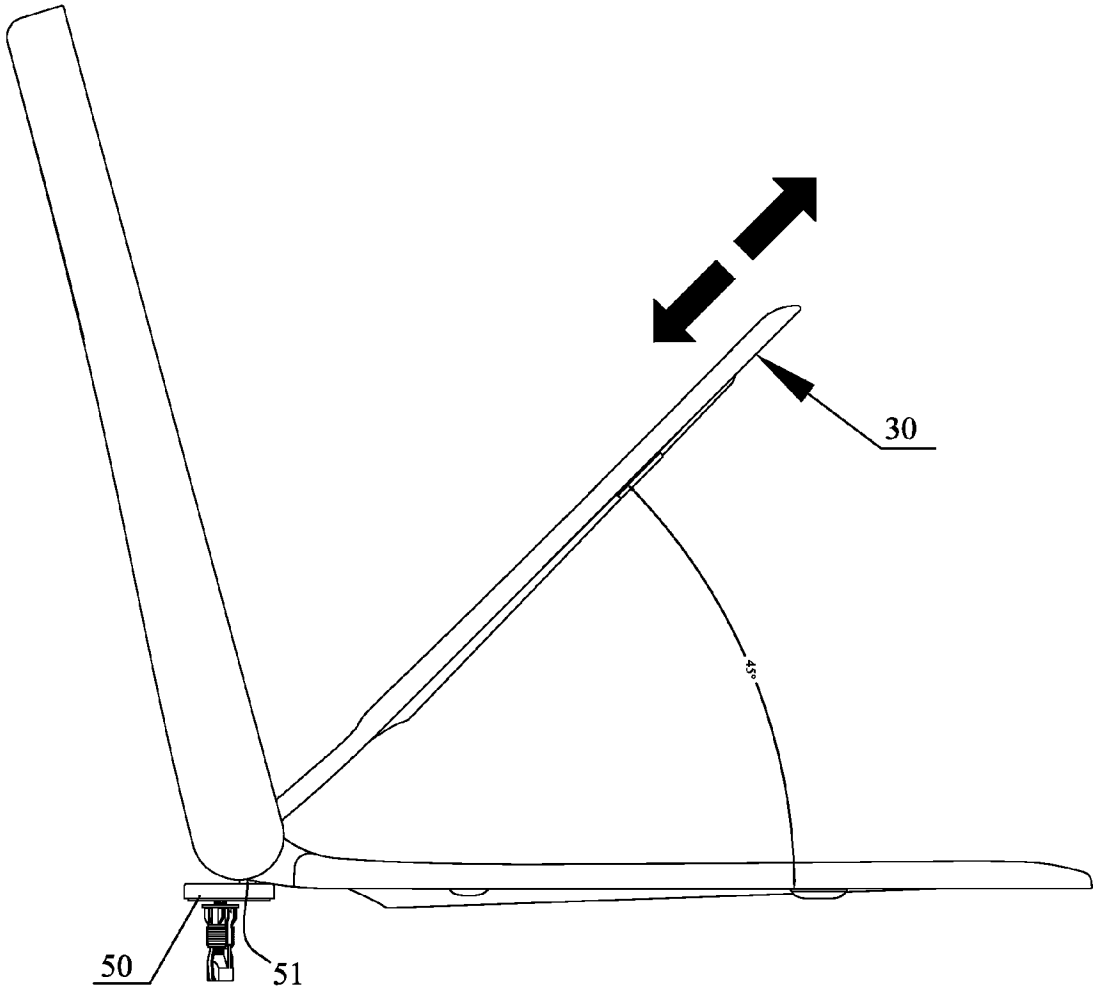
FIG. 5 is a schematic view showing the child seat of this invention which is opened by 45°.
Figure 8:
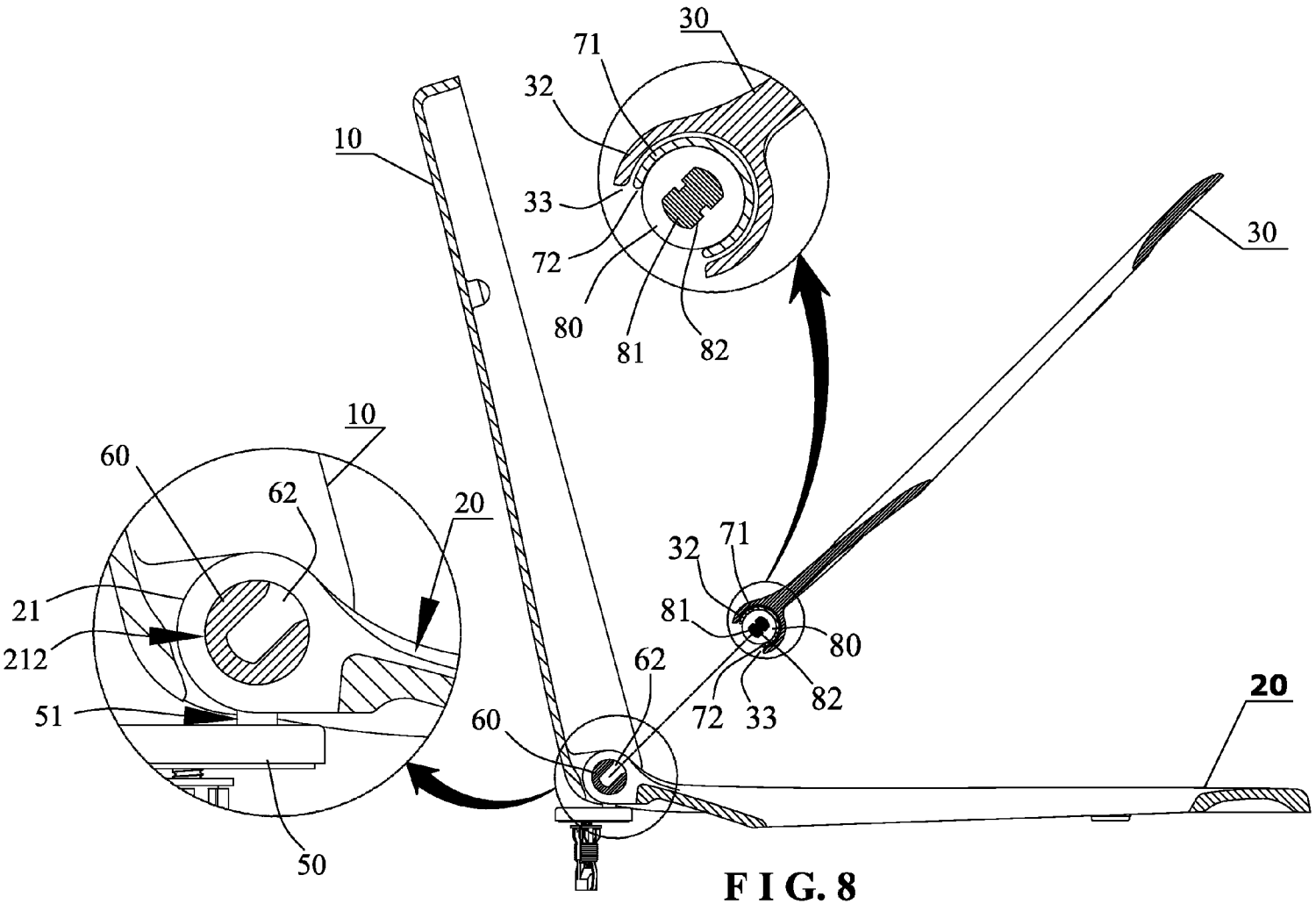
FIG. 8 is a schematic view showing a state of disconnecting the c-shaped ring and the central shaft from the shaft post.
Figure 12:
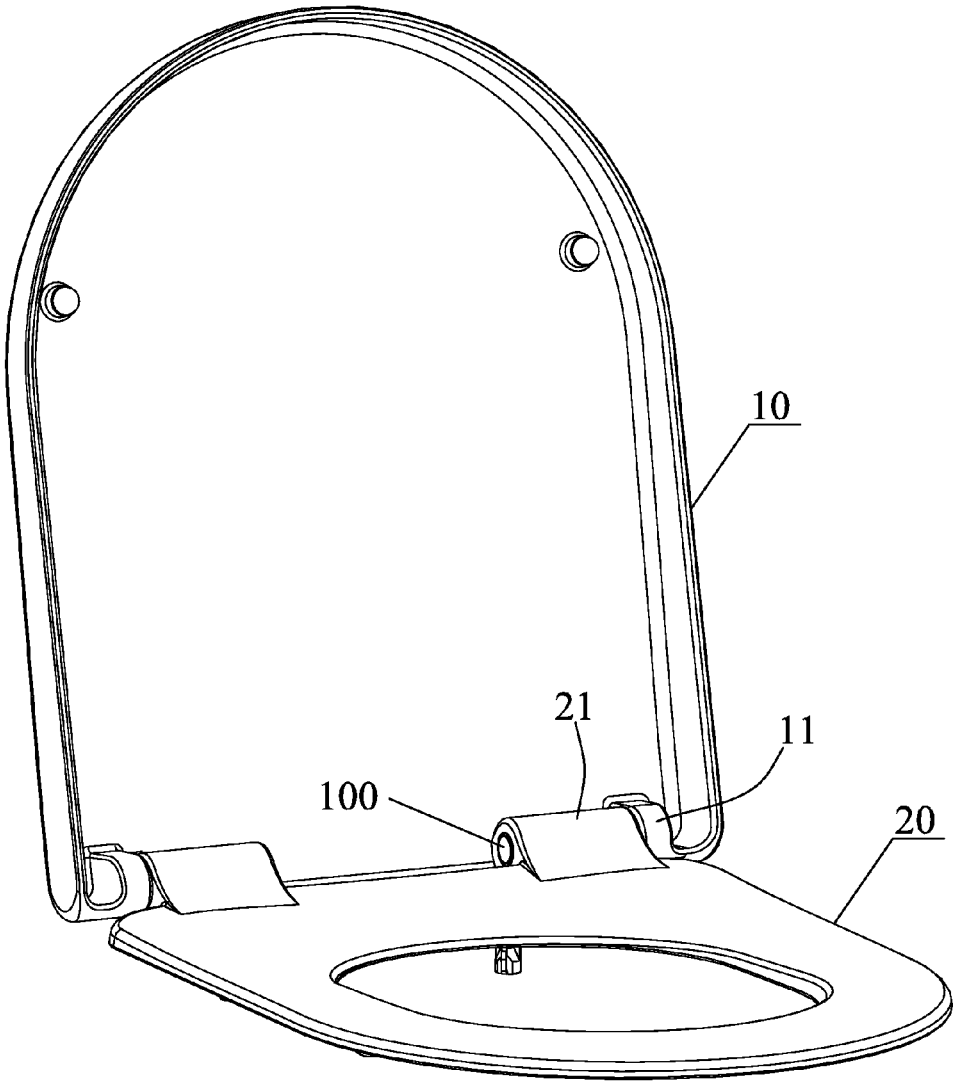
FIG. 12 is a perspective view of this invention showing the holes blocked by the plugs.

Referring to FIG. 5 and FIG. 6, to detach the child seat 30 from the fixing shaft 40 in the parent shaft sleeve 21, the child seat 30 is horizontally turned up by 45° so that the direction in which the damping output shaft 81 radially slides off the directional slot 62 can be the same as the direction in which the c-shaped ring 71 is disconnected from the shaft post 60. Then, the child seat 30 is pulled up in a slanting direction and extracted to disconnect the child seat 30 from the shaft post 60. As shown in FIG. 7 and FIG. 8, the damping output shaft 81 radially slides off the directional slot 62, and the c-shaped ring 71 is elastically forced and displaced so that the shaft post 60 can separate from the radial opening 72 of the c-shaped ring. Thereafter, as shown in FIG. 1, each positioning sleeve 61 of each shaft post 60 is pulled out of each hole 212, and the elements of the child seat 30 and the shaft posts 60 are removed. Finally, as shown in FIG. 11 and FIG. 12, the plugs 100 are adapted to block the holes 212 so that this invention can be converted into a general toilet seat cover for the closestool by combing the upper lid 10, the parent seat 20, the pivots 90, the fixing shafts 40 and the supports 50 together.

While the embodiment of this invention is shown and described, it is understood that further variations and modifications may be made without departing from the scope of this invention.

We claim:

1. A toilet seat cover with an easily assembled and detached child seat comprising an upper lid hinged to a parent seat and a child seat disposed between said upper lid and said parent seat, a child shaft sleeve being disposed in a rear of said child seat and located between two parent shaft sleeves which are disposed at two sides of a rear of said parent seat, each of said two parent shaft sleeves having a fixing shaft disposed therein for allowing a rotation thereof about said fixing shaft, two supports with respective pins being disposed, each of said pins being radially inserted in or extracted from each of said fixing shafts;

wherein a cylindrical shaft post is axially sleeved on each of said two fixing shafts, two elastic c-shaped rings being respectively disposed at two ends of said child shaft sleeve and respectively sleeved on said shaft posts in a radial direction, at least one of said two ends of said child shaft sleeve having a central shaft radially inserted into a directional slot;

wherein when a direction in which said c-shaped ring is radially sleeved on said shaft post is the same as a direction in which said central shaft is radially inserted into said directional slot, said shaft post provides a radial insertion and extraction fit with said c-shaped ring, and said central shaft provides a radial insertion and extraction fit with said directional slot, when a direction in which said c-shaped ring is radially disconnected from said shaft post is different from a direction in which said central shaft is radially withdrawn from said directional slot, said c-shaped ring and said central shaft cooperate to limit said shaft post.

2. The toilet seat cover with the easily assembled and detached child seat as claimed in claim 1, wherein two lid shaft sleeves disposed at two sides of a rear of said upper lid are respectively sleeved on said two parent shaft sleeves of said parent seat by respective pivots.

3. The toilet seat cover with the easily assembled and detached child seat as claimed in claim 1, wherein said directional slot radially defined by said shaft post goes up from a horizontal and slopes, or said directional slot is perpendicular to a horizontal surface.

4. The toilet seat cover with the easily assembled and detached child seat as claimed in claim 3, wherein said directional slot radially defined by said shaft post goes up from said horizontal and slopes by 45°±3°.

5. The toilet seat cover with the easily assembled and detached child seat as claimed in claim 1, wherein a buffer is sleeved on and fixed in said child shaft sleeve, said central shaft being a damping output shaft of said buffer, said damping output shaft being disposed in said c-shaped ring, two flat stop surfaces being radially formed on said damping output shaft to abut on said directional slot.

6. The toilet seat cover with the easily assembled and detached child seat as claimed in claim 5, wherein an adapting sleeve is sleeved on and fixed to each of said two ends of said child shaft sleeve, said c-shaped ring being disposed on said adapting sleeve, a rigid c-shaped sleeve being formed at each of said two ends of said child shaft sleeve and sleeved on an outer wall of said c-shaped ring, a clearance fit being provided between said c-shaped ring and said c-shaped sleeve.

7. The toilet seat cover with the easily assembled and detached child seat as claimed in claim 6, wherein said buffer is sleeved on and fixed in said adapting sleeve, said damping output shaft of said buffer being projected from said adapting sleeve and located inside said c-shaped ring.

8. The toilet seat cover with the easily assembled and detached child seat as claimed in claim 1, wherein a positioning sleeve is axially disposed on said shaft post, a positioning pin being axially disposed on said fixing shaft, said positioning sleeve and said positioning pin being held with each other.

9. The toilet seat cover with the easily assembled and detached child seat as claimed in claim 8, wherein an end of each of said parent shaft sleeves forms a hole, said positioning sleeve being inserted into said hole for holding said positioning pin of said fixing shaft in said parent shaft sleeve, a running fit being provided between said hole and said positioning sleeve.

10. The toilet seat cover with the easily assembled and detached child seat as claimed in claim 9, further including two plugs for blocking said holes respectively.

* * * * *